US009978470B2

(12) United States Patent
Gelis et al.

(10) Patent No.: US 9,978,470 B2
(45) Date of Patent: May 22, 2018

(54) IMMOBILIZATION OF ORGANIC RADIOACTIVE AND NON-RADIOACTIVE LIQUID WASTE IN A COMPOSITE MATRIX

(71) Applicants: Artem V. Gelis, Naperville, IL (US); Andrew J. Castiglioni, Chicago, IL (US); Dennis Kelley, Indianapolis, IN (US); Anatoliy Galkin, Almaty (KZ); Nadezhda Bachilova, Almaty (KZ); Alexandr Klepikov, Almaty (KZ); Alexandr Blynskiy, Almaty (KZ); Turgynbek Tolebayev, Almaty (KZ)

(72) Inventors: Artem V. Gelis, Naperville, IL (US); Andrew J. Castiglioni, Chicago, IL (US); Dennis Kelley, Indianapolis, IN (US); Anatoliy Galkin, Almaty (KZ); Nadezhda Bachilova, Almaty (KZ); Alexandr Klepikov, Almaty (KZ); Alexandr Blynskiy, Almaty (KZ); Turgynbek Tolebayev, Almaty (KZ)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days. days.

(21) Appl. No.: 14/967,935

(22) Filed: Dec. 14, 2015

(65) Prior Publication Data

US 2017/0169907 A1 Jun. 15, 2017

(51) Int. Cl.
*G21F 9/16* (2006.01)

(52) U.S. Cl.
CPC ..... *G21F 9/167* (2013.01); *G21F 9/162* (2013.01); *G21F 9/165* (2013.01)

(58) Field of Classification Search
None
See application file for complete search history.

(56) References Cited

U.S. PATENT DOCUMENTS 4,363,757 A * 12/1982 Koster ..... G21F 9/167 264/0.5
5,545,796 A * 8/1996 Roy ..... G21F 9/34 250/506.1

(Continued)

FOREIGN PATENT DOCUMENTS

JP 03021896 * 1/1991
JP 031155896 * 5/1991

OTHER PUBLICATIONS

Caire-Emilie Vaudey et al., NOCHAR polymers: an aqueous and organic liquid solidification process for Cadarache LOR (Liquides Organiques Radioactifs)—13195, WM2013 Conference, Feb. 26-28, 2013, 16 pages, Phoenix, Arizona USA.

*Primary Examiner* — Sheng H Davis
(74) *Attorney, Agent, or Firm* — Cherskov Flaynik & Gurda, LLC

(57) ABSTRACT

A method for immobilizing liquid radioactive waste is provided, the method having the steps of mixing waste with polymer to form a non-liquid waste; contacting the non-liquid waste with a solidifying agent to create a mixture, heating the mixture to cause the polymer, waste, and filler to irreversibly bind in a solid phase, and compressing the solid phase into a monolith. The invention also provides a method for immobilizing liquid radioactive waste containing tritium, the method having the steps of mixing liquid waste with polymer to convert the liquid waste to a non-liquid waste, contacting the non-liquid waste with a solidifying agent to create a mixture, heating the mixture to form homogeneous, chemically stable solid phase, and compressing the chemically stable solid phase into a final waste form, wherein the polymer comprises approximately a 9:1 weight ratio mixture of styrene block co-polymers and cross linked co-polymers of acrylamides.

20 Claims, 2 Drawing Sheets

(56) References Cited

U.S. PATENT DOCUMENTS

| | | | | | |
|---|---|---|---|---|---|
| 5,569,153 | A * | 10/1996 | Mallow | C04B 18/021 | 106/697 |
| 5,649,323 | A * | 7/1997 | Kalb | G21F 9/36 | 252/625 |
| 2006/0074141 | A1 * | 4/2006 | Hayner | G21F 1/10 | 523/136 |

* cited by examiner

IMMOBILIZATION OF ORGANIC RADIOACTIVE AND NON-RADIOACTIVE LIQUID WASTE IN A COMPOSITE MATRIX

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to immobilizing radioactive waste and more specifically, this invention relates to a method and construct for sequestering liquid radioactive waste.

2. Background of the Invention

The immobilization and disposition of liquid (both aqueous and nonaqueous) radioactive waste (LRW) and nonradioactive waste such as pump oil, spent solvent, and crude oil spills, remain a significant challenge for chemical and nuclear industries.

LRW has been mixed with polymers in efforts to immobilize the LRW. However, the resulting construct is nothing more than a loose aggregate. These constructs do not meet the requirements of the United States and some foreign jurisdictions for hardened waste necessary for land disposal wherein exterior casings are not utilized.

Strict United States guidelines (10 CFR Part 61) as promulgated by the Nuclear Regulatory Commission (NRC) for permanent land disposal of radioactive waste dictates a myriad of benchmarks for safe encapsulation and storage, including the following metrics:

Compressive strength,
Thermal cycling,
Irradiation,
Biodegradation,
Short term and long term leach tests,
Immersion tests,
Free liquids/bleeding, and
Flammability, whereby actual size waste forms are tested.

To date, very few radiation encapsulation protocols exist to meet Part 61 requirements. This is partly because disposal scenarios of radioactive waste often include nonradioactive waste streams. For example, 90 to 95 percent of the primary loops of breeder reactors are sodium cooled. Pumps are required to circulate the molten sodium and pump oil is used to keep the pumps operational. As a result, the pump oil becomes contaminated and over time, this contaminated oil needs to be disposed of safely. Techniques for efficiently disposing of all of these waste streams together and at reasonable cost remain elusive.

Attempts to solidify LRW-polymer constructs with cement have had limited success. This is because the cement prevents polymerization from occurring. In addition, significant amounts of water can result in the destruction of cement through the polymer absorption process. Any monoliths generated therefore lack the rigidity and/or water repulsion requirements of the NRC and foreign NRC counterparts.

Some jurisdictions allow heterogeneous waste forms to be generated, whereby solidified LRW is placed into bags, with the bags subsequently encapsulated in cement.

A need exists in the art for a single method to simultaneously sequester aqueous and non-aqueous (e.g. organic) nonradioactive waste and radioactive waste. The method should be simple to deploy and rely on relatively inexpensive, nontoxic sequestration agents. The method should not require controlled atmospheres or high pressures or temperatures when treating organic waste forms.

SUMMARY OF INVENTION

An object of the invention is to provide a method for simultaneously sequestering radioactive and nonradioactive substances for permanent land (e.g. underground geologic) disposal that overcomes many of the drawbacks of the prior art. The method utilizes both mechanical and chemical processes to generate a homogeneous, disposable mass which meets NRC parameters.

Another object of the invention is to immobilize liquid radioactive waste. A feature of the invention is the chemical and/or mechanical sequestration of the waste in a polymer-aggregate homogeneous mixture. An advantage of the invention is that the resulting construct is stable inasmuch as it will prevent leaching of the waste into the environment, it reduces the risk of fire, and it suppresses the formation of vapor.

Still another object of the invention is the simultaneous sequestration of liquid phase radioactive waste and solid phase nonradioactive waste. A feature of the invention is the combination of organic radioactive waste with sulfur to form a solid impermeable monolith. An advantage of the invention is that the monolith repels water and prevents water encroachment so as to satisfy 10 CFR Part 61 requirements of NRC radioactive waste encapsulation guidelines at relatively low costs compared to other protocols.

Briefly, the invention provides a method for immobilizing liquid (both aqueous and non-aqueous) radioactive waste, the method comprising absorbing the waste with polymer to form a non-liquid waste (i.e. free flowing partially-dry or granulated form, such as an aggregate); contacting the non-liquid waste with a solidifying agent to create a mixture; heating the mixture for a time and at a temperature to form a homogeneous and chemically stable solid phase such that the waste, polymer and filler irreversibly bind to each other; and compressing the stable solid phase into a final waste form.

The invention also provides a method for immobilizing liquid radioactive waste containing tritium, the method comprising mixing the liquid waste with polymer to convert the liquid waste to a non-liquid waste, contacting the non-liquid waste with a solidifying agent to create a mixture, heating the mixture for a time and at a temperature to form homogeneous, chemically stable solid phase, and compressing the chemically stable solid phase into a final waste form, wherein the polymer comprises approximately a 9:1 weight ratio mixture of styrene block co-polymers and cross linked co-polymers of acrylamides.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
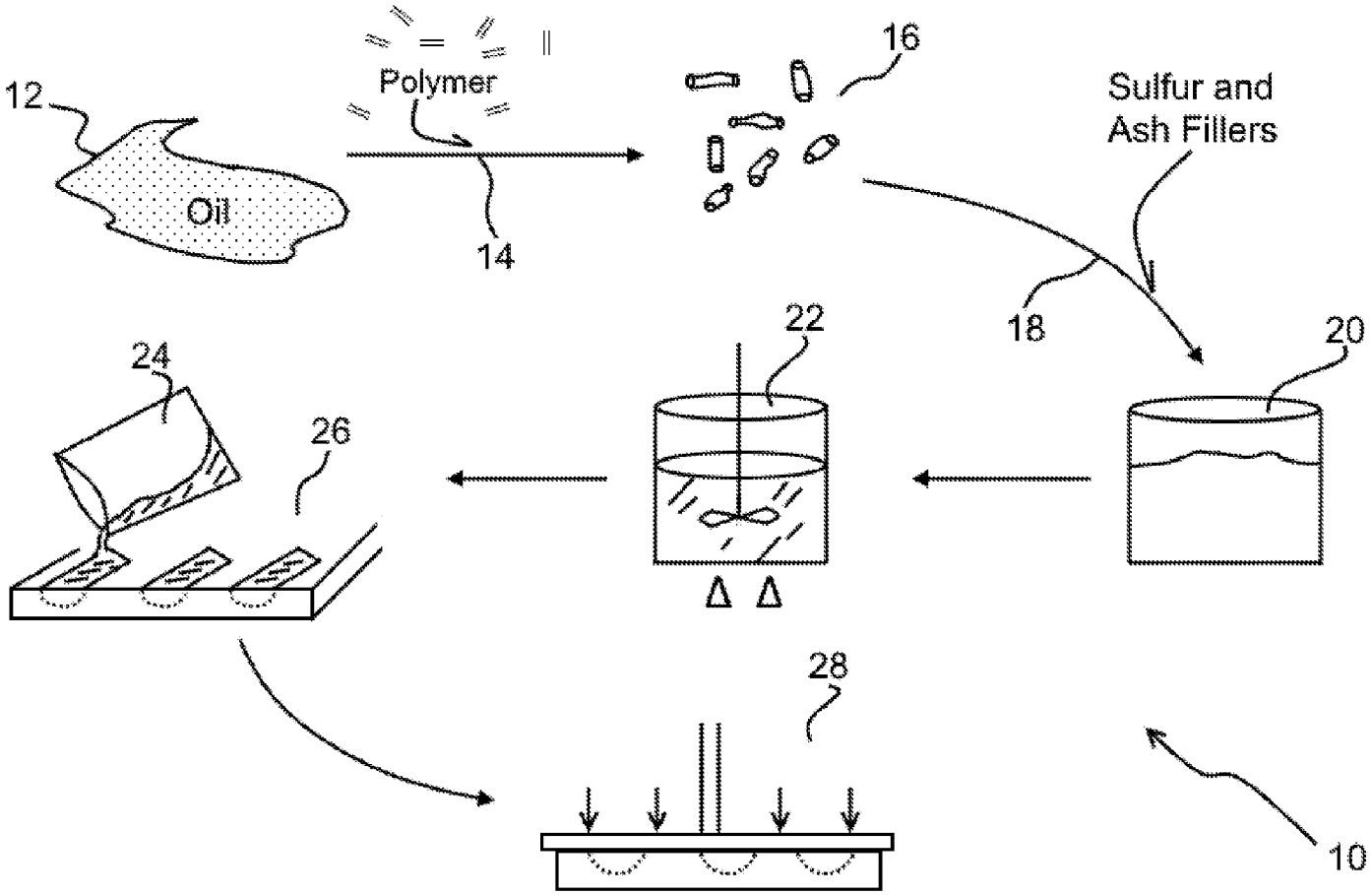
FIG. 1 depicts a flow chart of a protocol for sequestering radioactive and nonradioactive material, in accordance with features of the present invention.

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one skilled in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides a method for solidification of organic waste, inorganic waste, and radioactive material. 10 CFR § 61.56 defines radioactive waste characteristics and guidelines for disposal that the invented method achieves, including the following:

- Generally, liquid radioactive waste must be solidified or packaged in sufficient absorbent material to absorb twice the volume of the liquid.
- Solid waste containing liquid shall contain more than 1 percent in volume of free standing and noncorrosive liquid.
- Waste must not be readily capable of detonation or of explosive decomposition or reaction at normal pressures and temperatures, or of explosive reaction with water.
- Waste must not contain, or be capable of generating, quantities of toxic gases, vapors, or fumes harmful to persons transporting, handling, or disposing of the waste.
- Waste must not be pyrophoric.
- Waste must have structural stability in that it does not degrade, slump or collapse so as to be susceptible to water infiltration. Structural stability can be provided by the waste form itself, e.g., processing the waste to a stable form.

Generally, the method comprises first mixing liquid radioactive waste with a macromolecule comprising several monomers. The monomers are generally styrene block co-polymers or cross linked co-polymers of acrylamide, or combinations thereof, commercially available for example as the "N" series polymers from Pacific World Trade (Indianapolis, Ind.) and Nochar (Indianapolis, Ind.). Polymers such as those described infra, are chosen depending on whether the radioactive liquid is aqueous or nonaqueous, to initially immobilize the liquid phase. Where non-aqueous waste is being immobilized, styrene block co-polymers are preferred, such as Nochar's N910. Where aqueous liquid waste is being immobilized (for example when tritium contaminated oil is the LRW) cross-linked co-polymers of acrylamide are preferred, such as Nochar's N960.

Generally immobilization (upon mixing with polymer) takes the form of a free flowing solid phase such as solid aggregate, i.e., dry granulated forms.

The aggregate is then homogeneously combined with other, initially solid phase waste including inorganic filler such as ash and nonmetals (e.g. sulfur, selenium).

After mixture is complete, the mixture is heated for a time sufficient to produce a homogeneous, chemically stable compound. Generally, temperatures are chosen below the flash point of the LRW. For example, radiation contaminated pump oil has a flash point of approximately 210° C. As such, temperatures up to about 210° C. are suitable, temperatures up to about 180° C. preferred, and temperatures between about 140° C. and about 165° C. most preferred. In an embodiment of the invention where the flashpoint of organic waste constituents (e.g., kerosene) is below the aforementioned temperature ranges, then heat treatment is conducted in an inert atmosphere (e.g., nitrogen gas, argon gas, or an atmosphere with concentrations of oxygen incapable of supporting combustion or burning) or in an atmosphere not reactive to the mixture constituents.

After heat treatment, the material is pressure molded.

The inventors found that up to 75 percent of the final product may initially have been liquid radioactive waste. Conversely up to 75 percent of the final product may initially have been other than liquid radioactive waste.

The cost-effectiveness of the invented method in comparison with cementation or vitrification results from the fact that two industrial waste streams (e.g., organic waste and sulfur waste) are combined to generate one robust waste storage form, whereby the form is homogeneous in its consistency throughout. For example, crude oil producers normally pay for the disposition of the sulfur waste generated during the oil refining process. Surprisingly and unexpectedly, the inventors found that the incorporation of this waste sulfur as a constituent in the final waste form reduced the amount of polymer otherwise required to sequester the liquid radioactive waste, and further enhanced the hydrophobic qualities of the final waste form. The result is the production of a final waste form that satisfies Part 61 of the NRC radioactive waste guidelines.

In an embodiment of the invented method, designated as numeral 10 in FIG. 1, liquid radioactive waste oils (or oils from spills) 12 are collected using styrene block co-polymers 14, such as Nochar 910, to immobilize the waste. This immobilized waste is non-liquid in consistency or form, and may be a free flowing solid (e.g., a granulated form, similar to an aggregate.) For example, at this juncture in the process, the non-liquid immobilized waste may take the form of damp pulverized clay when first formed. Over 24 hours or so, the pulverized clay consistency may desiccate somewhat so as to be more dry than when first formed.

The immobilized waste 16 is then combined with a mixture 18 of grounded sulfur and grounded fillers (such as ash and/or barite) to create a homogeneous mixture 20. This mixture 20 may, depending on the filler type, exhibit a lower liquid content than the non-liquid immobilized waste, due to the drying qualities of the filler.

The mixture 20 is then subjected to a reaction sequence 22 wherein the mixture is heated up to approximately 140° C. for approximately 2 hours while stirring. The reacted mixture 24 is then poured or otherwise confined in molds 26. Finally, the confined mixture is hardened into a monolith by pressure molding 28. Suitable pressures are those up to approximately 20 MPa.

Sulfur polymer composite monoliths produced by the invented method exceed the NRC compressive strength limit (35 kg/cm$^2$) by a factor of 3. Further, the final forms have cesium (Cs) and Cs-salt leach rates lower than common cement-based waste forms.

Inorganic Filler

Detail

A myriad of fillers are suitable. Generally, such fillers are chemically-neutral solid material such as ash, barite, fluorite, pyrite dross, shale, blast furnace slag, chrysotile, fluorspar concentrate, shell limestone, metal particles and powders such as lead powder, stainless steel powder, and combinations thereof). When mixed with thermoplastic binding substances, the selected fillers determine the physical and chemical resistance of the final waste forms. The inventors found that waste forms incorporating any of the aforementioned fillers meet or exceed the NRC Part 61 regulations discussed supra.

Thermoplastic binding substances, such as nonmetals with oxidation states between approximately 2 and approximately 6 are particularly suitable for mixing with the aforementioned fillers. Such nonmetals include sulfur, sulfur containing compounds, selenium and selenium containing compounds, and combinations thereof. Sulfur is a particularly viable waste form for use with the invention inasmuch as approximately 1 kilogram (kg) of waste molecular sulfur is generated for every 85 gallons of gasoline produced. In an embodiment of the invention, sulfur comprises between approximately 20 and approximately 60 percent of the inorganic filler contingent to generate a radiation-resistant sulfur composite (RRS).

The feasibility of using sulfur follows from the analysis of requirements for materials operated in conditions of ionizing radiation. The main requirement for components of radiation-resistant composite materials is their resistance to operational effects. From the theoretical positions for creation of radiation-resistant materials it is appropriate to use substances consisting of metal or molecular crystals, i.e., dominated by non-directional nature of connection.

Elementary particles in molecular crystals are connected by relatively weak van der Waals forces, and therefore, these crystals have low melting point, high temperature coefficient of linear expansion and relatively low strength. However, the substances that have this type of structure are advisable to use for fabrication of composites that undergo low-intensity radiation exposure during operation with simultaneous action of chemically active media.

The inventors have found that sulfur has significant advantages among the substances that have molecular crystal structure. Sulfur crystals consist of closed molecules, which atoms are bound by strong covalent bonds. Exposure to ionizing radiation leads to the rupture of interatomic bonds, formation and stabilization of polymeric sulfur, which is an unstable modification reversing to a crystalline phase with heat release. Ionizing radiation impacts polymerization of sulfur (activates polymerization process and increases the length of polymer chain) and stabilization of its polymer modification.

Polymeric sulfur formed under the influence of ionizing radiation eventually reverses in crystal modifications, so the sulfur-based compounds require introduction of a modifier. The most stable modifications of sulfur are formed during use of the aforementioned polymers as modifiers. This provides a foundation to assume that polymers used to immobilize LRW can form copolymers when reacting with sulfur that are resistant under radiation exposure. Thus, the sulfur has a high resistance to radiation due to its molecular structure and ability to polymerize, while absorbing the energy of radiation and dissipating it as heat without undergoing significant changes. With the increase of photon energy above 1.173 MeV the integral absorption coefficient of γ-radiation of sulfur (average density of 1950 to 1970 kg/m$^3$) increases sharply, while for cement concrete (average density 2350 kg/m$^3$) the absorption coefficient decreases. This is due to development of, at least, a two-step mechanism of absorption. At $E\gamma>1$ MeV the interaction of photons with electron shells of atoms of sulfur leads to separation of majority of the outer electrons. The separated free electrons are responsible for multiple gain of the Compton scattering. At $E\gamma-0.3$ MeV the Compton scattering on valence electrons of sulfur is not effective due to large binding energy. Introduction of modifying additives allows to increase absorption efficiency of γ-radiation on 22.6 . . . 46.5%.

The significant reserves of oil sulfur in oil producing countries such as the United States, Russia, and the middle east, combined with the intense interest in nuclear science in these venues, enhances the viability of utilizing sulfur as a constituent of composites for immobilization of LRW. The melting temperature of sulfur is 119° C., and the temperature, at which sulfur has minimum viscosity of the melt is 155° C. Thus, in this temperature range it is possible to obtain composites from sulfur with mineral fillers and LRW absorbed by polymer.

In summary of this point, a feature of this method is that the liquid is absorbed by polymer at a range of temperatures (e.g., below the flashpoint of the liquid) and the polymeric additive can be copolymerized with sulfur to form a stable, radiation resistant material for prolonged storage. However, no temperature limitations are required if the invented method is conducted in a controlled atmosphere, e.g. one containing noncombustible concentrations of oxygen.

Sulfur Preparation

Detail

Radiation resistance and mechanical strength of sulfur based composites are ensured by polymer modification of sulfur to create conditions to transfer greatest possible amount of sulfur into its polymeric state, and then, to preserve sulfur in the polymeric state by introducing various chemical additives (it is enough for about 20% of sulfur in the polymer state to use sulfur as a binding material. Fillers with high density are used—barite, pyrite cinder, shale in order to form radiation-resistant composite structure, in which polymorphic transformations of sulfur will not have destructive action and provide radiation resistance of materials.

The invention teaches how to disperse these natural minerals, methods of introduction and compacting of sulfur composites that ensure stabilization of sulfur and exclude the destructive effect of its polymorphism and recrystallization. Fillers with high density are used—barite, pyrite cinder, shale in order to form radiation-resistant composite structure, in which polymorphic transformations of sulfur will not have destructive action and provide radiation resistance of materials.

Performance properties of the material are determined not only by the properties of source components, but also by methods of compaction. The strength and stability of RRC (Radiation-Resistant Composite) structure, and, consequently, radiation, strength and deformation properties and durability are determined primarily by the nature and magnitude of the interaction forces (bonds) occurring at the surface of phase separation between binding-filler during compaction.

The inventors found that interaction of sulfur and mineral components in pieces and powder form is different. In dispersed mineral powders the particles consist entirely of one mineral, which is part of the rock. During compaction of sulfur composites the purpose of introducing fillers is to give them the radiation resistance, strength, deformability and physic-chemical stability required by the operating conditions of the material during storage.

The highest density of the filler is achieved when the particles of subsequent fractions are placed in the cavities of previous fraction without shifting particles or with minimal shifting. The best way to maintain this principle is when designing the mineral mixtures by discontinuous granulometry. Application of the principle of discontinuous granulometry of filler compositions has proved useful with regard to RRC. If selection of the filling system according to the rules of discontinuous granulometry provides a minimum consumption of the binder, then the costs for precision fractionation of fillers are justified.

To establish the limit of reasonable grinding, the mechanical strength properties of RRC equally filled by powders with different dispersion were determined and the test results showed that the sharp increase in strength of sulfur composites occurs with increasing of dispersion of powders to about 5000 $cm^2/g$.

The inventors determined that radiation properties of RRC depend not only on the granulometry and density of the filler, but also on the nature and mineralogical composition. Maximum values of strength and radiation resistance of compositions appear when there is a combination of sulfur grind with certain fillers, which suggests the existence of optimal pairs of sulfur-filler. Thus, the solid solutions with the structure of barite are insensitive to radiation and have virtually unlimited resistance to radiation, which is primarily demonstrated in the absence of swelling.

It has been the inventor's observations that in crystals of compounds with large quantity of disordered stoichiometric vacancies in ionic sub lattices, displaced atoms formed as a result of irradiation, are not able to remove at considerable distances from their vacancies. This is due to violation of the mechanism of focused movement of dynamic crowd ions along dense atomic planes and chains of atoms. Other mechanisms of movement of displaced atoms are ineffective. As a result, majority of displaced atoms cannot leave the zone of instability around generated vacancies. This leads to an instantaneous thermal annihilation of the vast majority of radiation-induced defects in the form of Frenkel pairs "displaced atom-vacancy". Radiation defects in "displacement cascades" annihilate the same way. As a result of annihilation, the stable radiation defects do not accumulate in crystals or accumulate very slowly without taking part in the change of their properties. If there are no other reasons to change the properties of the material under irradiation, for example, accumulation of gas products of nuclear reactions, than it is less sensitive to radiation damages.

In summary of this point, the filler's properties influence the properties of RRC. RRC comprising disperse powder will ensure a high radiation resistance and strength due to structure compacting and likely mechanical activation of fillers and sulfur during the grinding process.

The inventors studied the joint effect of micro fillers and microfibers on the properties of RRC, the ratio of which was chosen in such a way that it allows for possible orientation interaction of sulfur composite particles, which leads to compaction and hardening of the system. Application of micro fillers together with reinforcing additives significantly increases the strength characteristics. While the use of single fillers satisfied the NRC requirements for geologic deposition, RRCs comprising binary micro fillers (mineral and fiber) were stronger than similar composition samples with micro fillers only of individual minerals.

The strength and stability of the RRC structure, and therefore operational properties—radiation resistance, strength and deformation properties and durability of sulfur composites are determined primarily by the nature and magnitude of the interaction forces (bonds) occurring at the interface of binder-filler.

The inventors found that performance characteristics of the finished sulfur composites are directly dependent not only on the quality of initial components and their relations, but may also be determined by the methods of their preparation and further process of compaction. Aggregates and/or powders of minerals, rocks and man-made materials: acid-resistant rocks of different mineralogical composition, limestone, diatomite, and chrysotile were used as component-fillers.

The following sulfur radiation-resistant composite materials are suitable for use with the invented method: Micronized sulfur as a binder, natural nano-dispersion shell limestone, dry ash selection, barite concentrate—as fillers, and chrysotile as dispersion-reinforcing additive. Increasing dispersion of components correlates with increasing strength limit of material. Thus, with the increase of specific surface of limestone from 150 to 300 $m^2/kg$ the compressive strength of composition has increased from 22 to 38 MPa and the bend strength has increased from 7 to 10 MPa.

Further increases of the specific surface lead to material strength reduction. For example, material which contains a considerably greater number of grains of angular shape with a rougher surface confers greater radiation resistance. This is because the angular shapes enhance adhesion between the filler and sulfur, which increases the strength of the composite in general. Shale has such angularity. Furthermore, increasing of the RRC strength occurs as a result of higher reactivity of crushed shale whose particles after grinding have a higher surface activity as a result of partial rupture of the Si-0-Si connections in crystalline lattice.

The degree of filling of the material affects the strength of RCC in addition to geometric dimensions. When a certain value of degree of mass filling is achieved the strength of sulfur composites is increased in 2-3 times in comparison with the strength of unfilled sulfur. The introduced fillers act as structure builders, and a sort of "shock absorber" that reduce internal stresses by 60-80 percent.

Introduction of fibrous fillers improves the strength of sulfuric composite material and prevents the negative impact of uneven cooling of the products. The inventors envision that the fibers are centers of crystallization which promote uniform and fine crystalline structures. This leads to increased material strength. Suitable filters comprise those materials discussed herein and include chrysotile, ash, barite, etc., and combinations thereof. The strength of sulfur material is also affected by concentration of fibers. With the increase of fiber content to between about 10 percent and about 13 percent of sulfur weight, the tensile strength and bending strength increase linearly.

Properties of sulfur materials were adjusted with different modifying additives. Depending on the functional purpose the modifying additives are divided into plasticizing, stabilizing, gas- and air-entraining as well as the additives that increase resistance to radiation, fire and bio-resistance of sulfur materials etc. Suitable plasticizing additives include naphthalene, paraffin, dicyclopentadiene, Thiokol, rubber crumb and others. These additives, in addition to plasticizing of sulfur composite, facilitate the removal of air, increase the strength, reduce the brittleness and prevent crystallization of sulfur during cooling.

As a result of interaction of sulfur with additives (or their degradation products) a certain amount of polymeric sulfur is formed, which has a higher deformability, tensile strength, greater adhesion to fillers and less internal stresses during transition from viscous-liquid to solid state in comparison with the crystal modifications of sulfur. Amount of polymeric sulfur can be adjusted by the melt temperature, isothermal holding time, type and content of stabilizing agent.

To obtain a material with high mechanical and performance properties it is enough to have sulfur with 40-60% content of polymer modification. Polymer modification of sulfur with the passage of time at room temperature will cause reversion to crystalline structure. Different stabilizing additives were used to prevent this process. Suitable additives include, but are not limited to red phosphorus, iodine and their mixture, selenium, sesquialteral arsenic sulfide, dicyclopentadiene, Thiokol, hexachloroparaxylene and combinations thereof. These stabilizers interact with sulfur, joining the ends of polymer chain, "saturate" free valences, terminate polymerization process and convert material into a cross linked polymer. This leads to a drastic decrease in the rate of depolymerization.

Reduced flammability of sulfur composites is achieved by introduction of antyperenes into its structure, such antyperenes including but not limited to hexa-brominebutane, pentachloride phosphorus and combinations thereof. The following technological methods enable the fabrication of radiation-resistant sulfur composites: Filler heated to about 140-150° C. was introduced in the sulfur melt to obtain a homogeneous mass. The mixture was thoroughly mixed, maintained for 10-15 minutes at a temperature of 150-160° C., placed into forms and vibrated for 10-15 seconds. After cooling within 30-40 minutes the forms were stripped.

Another technique for producing reduced flammability sulfur composites include the following: Dry mixture of sulfur with filler was placed into forms and compacted on shaking table. Then the forms were heated to 150-160° C., held for 10-15 minutes, and cooled. The filler was placed into forms, heated to 140-150° C. and poured with molten sulfur with compaction on shaking table.

Yet another technique for producing reduced flammability sulfur composites includes the following: Dry mixture of sulfur with a filler was prepared, heated to 150-160° C., the resulting mixture was placed into forms, vibrated for 10-15 seconds and then held for 10-15 minutes at a temperature of 150-160° C. and cooled.

In order to increase the strength of RRC, a "soft" cooling mode can be employed. as follows. The molded samples were cooled at 10-15° C./h until reaching the temperature 96° C. throughout the volume of product, and then cooling is carried out under natural conditions. Change of the density of sulfur in the process of crystallization and recrystallization causes the occurrence of shrinkage deformations that promote formation of micro cracks. Their quantity and nature depend on several factors, including the rate of cooling. Micro- and macro-cracks are occurring during rapid cooling. Slow cooling promotes redistribution of internal stresses, change of the fracture nature, formation of micro pores uniformly distributed throughout the sample volume.

A myriad of cooling protocols can be utilized in fabricating RRS composites. Three of the protocols are as follows:

- samples of radiation-resistant sulfur composite after molding were cooled in air at a temperature of about 20±2° C.;
- after molding the samples were placed in water at a temperature of about 20±2° C.;
- after molding the samples were subject to "soft" cooling mode, at a rate of about 15-20° C./h.

Compressive strength of the samples fabricated using the "soft" cooling mode the samples is approximately 30 to 40 percent higher than the samples, which were cooled in air and water.

However, the other cooling protocols presented in this specification are equally important and steps can be taken to prevent unevenness of cooling. For example, to increase the strength and ensure uniform cooling of products so as to prevent shrinkage cracks, chrysotile or other fibers can be introduced as a dry filler. Introduction of such a reinforcing material will allow avoiding negative impact on the strength of non-uniform cooling and help to ensure a fine-grained structure of sulfur, which is characterized by higher strength and thermal stability. Moreover, the step of forced cooling of products can be eliminated from the process of fabrication during introduction of chrysotile fibers into the concrete composition.

Cooling of radiation-resistant sulfur composite at a speed of about 10-15° C. per hour down to a temperature of 96° C. throughout the volume of products, and then to conduct cooling in natural conditions will promote redistribution of internal stresses, changes in the nature of crack formation via the generation of micro pores uniformly distributed throughout the material volume. Strength of products will increase between approximately 13 percent and approximately 28 percent, compared to those composites which are force cooled.

Water absorption of sulfur composites depends on many factors: sulfur content, type and concentration of modifying additives. The water absorption decreases with the increase of sulfur content. Thus, water absorption decreases by about 20 percent with the increase of the amount of sulfur from about 12 to about 15 percent. The amount of absorbed water also decreases with introduction of modifying additives to increase hydrophobic ability of the material. For example, compositions containing 12% of sulfur with modifier had the same water absorption as the compositions with sulfur consumption of 15%, but without additive. Type and amount of filler also affect the water resistance of radiation-resistant sulfur composite. This difference can be explained by different degree of adhesive bond of sulfur with the surface of fine filler.

Specific surface (morphology) and size of the filler also affects water resistance of radiation-resistant sulfur composite. Thus, when using pyrite cinders as a filler with a fraction of about 0.14-0.315 mm granular size, the water resistance of compositions is higher than that of the material filled with pyrite cinder with a fraction of 0.08-0.14 mm, (i.e., relatively smaller granular size). Surprisingly and unexpectedly, the porosity of radiation-resistant sulfur composite decreases when using more coarse (large granules) filler, and this increases its water repelling characteristics.

Generally the inventors observed a decrease in water absorption with an increase in sulfur content in composition. Introduction of fiber additives also affects the value and intensity of water absorption of radiation-resistant sulfur composite. For example, introduction of chrysotile in the amount of 1; 2; 4 and 8 weight percent % leads to a decrease in water absorption by 19; 38; 51 and 59 percent. At that, the rate of sorption (diffusion coefficient) of the modified material also decreases.

The same factors have impact on the resistance of radiation-resistant sulfur composite in aggressive environments as for the water resistance, namely: amount of sulfur, type and concentration of reinforcing additive, type, amount and specific surface of the filler. Shale was used as a filler to improve alkali resistance, and pyrite cinder—to improve acid resistance.

Frost resistance of radiation-resistant sulfur composite was determined based on micronized sulfur, mineral fillers and fiber additives. Frost resistance of dispersion-reinforced radiation-resistant sulfur composite based on limestone-shell is about F250, which is to say 250 freeze and thaw cycles. This is two times greater than the frost resistance seen in the samples prepared without fibrous fillers. Similar resistance is observed for dispersion-reinforced materials based on slate. Frost resistance of such materials is in two times greater than non-reinforced sulfur composites. Frost resistance of sulfur composites based on limestone-shell is over F250, based on shale—is over F300; and for dispersion-reinforced sulfur composite materials—is between about F250 and about F350.

Polymer Detail

Suitable polymers include elastomers for solidifying oils, organics, hydrocarbons, into solid disposable masses. Exemplary polymers include petroleum product bonding agents such as Nochar's N910 Petro Bond, Nochar's N960 polymer which is applied to aqueous waste such as acid, alkaline liquors, and water (e.g. heavy water, tritium) and Nochar's 935 which is applicable to light alcohols and combinations thereof. Nochar's N912 1% aqueous bond is also available. These polymers are commercially available from Pacific World Trade (Indianapolis, Ind.), and Nochar, Inc., as noted supra.

The inventors surmise that hydrophobic molecules comprising the N910 polymers facilitates encapsulation of radioactive waste-tainted pump oil, while simultaneously rendering the final waste form monolith impervious to aqueous compromise. (Typically, such pump oil contains salts of radioactive elements, such salts including cesium nitrate and cesium chloride. When solvents are being immobilized, very soluble radioactive elements are so entrained, those elements including uranium, plutonium, and americium.) Generally, the polymers can be mixed with liquid radioactive waste to the point where the polymers are saturated. The inventors found that LRW loading below polymer saturation points results in more rigid monoliths forming.

Several commercially available polymers are suitable for use in the invented method.

Specifically, N910 Bond is an efficient and effective polymer formulated to solidify oils, organics, solvents and other hydrocarbons into a solid mass for storage, transportation and disposal. N910 produces excellent TCLP results and has been tested to 2.7 million grey. (Gamma/Cobalt Source).

N910, N935 and N960 are frequently blended together to capture and solidify waste streams that vary in chemical composition. N941, N912, N964 are blends of the N910 and N960 polymers. N910 is a thermoplastic elastomer polymer. N960 is a co-polymer of acrylamide.

The inventors envision that a mixed waste, for example, up to about 90 percent oil and up to about 10-15 percent water and a combination of styrene block co-polymers and cross linked co-polymers of acrylamides (e.g., Nochar 910 and Nochar 960) will meet or exceed NRC guidelines. The inventors have found this to be true with cementation work. The inventors found that in a styrene block co-polymer: acrylamide ratio of about 9:1, the acrylamide portion (up to 10 percent portion) of the polymer mixture entraps (by absorbing) tritium so as to keep it from leaching into the environs. In summary of this point, up to 10 percent of the acrylamide polymer can be utilized in a multipolymer mixture to entrap tritium, and still facilitate solidification to a form for geologic deposit. However, acrylamide polymer (e.g. N960) used neat will completely encapsulate and immobilize tritium.

The polymer-waste constructs can be heated to assure chemical annealing of the final forms, prior to compression molding. Generally, temperatures should be below the flash point of the liquid being sequestered. Suitable temperatures ranges are from about 100° C. to about 300° C., preferably between about 120° C. and about 250° C. and most preferably between about 130° C. and about 200° C. Applied temperatures ranging between about 130 and 160° C. are typical. In instances where tritium is absorbed to acrylamide polymer, it is preferred that the heating occur in a controlled atmosphere so as to capture any tritium outgassing which may occur. Such controlled atmosphere would include a hot cell, glove box, chemical hood or application of a negative pressure pull so as to prevent outgassing of tritium to the ambient environment.

Polymers, such as those described above may incorporate enriched Boron for waste streams containing active neutron sources. These polymers may also be blended with sodium carbonate to adjust the ph ratios and solidify in a one step process. Such carbonate blends can be used with organic waste containing tri butyls.

The polymers can be mixed and applied to treat oil/water emulsions. For example, the polymers can act as "filters" by capturing one type of liquid (oil) while allowing water to run freely. In this filtering embodiment, the polymer-organic LRW construct is the actual filter through which water and water solubilized solute can run through unimpeded as filtrate. The filtrate can then be processed downstream, for example by heating to evaporation, or contacting the filtrate to polymers specific for immobilizing aqueous based fluids.

Resulting monoliths may be rigid, semi-rigid, flexible, or reversibly deformable. For example the inventors found that co-polymerization with oil and sulfur resulted in a rubber-like compound. This confers a benefit viz the NRC compressive requirements inasmuch as such a rubbery monolith has high compressive strength and water resistance relative to monoliths formed from nonflexible constituents such as granules or aggregates.

Organic waste solidification occurs in two steps. As the organic liquid permeates through the polymer strands, the strands swell and immobilize the liquid. Then as the polymer-organic cure, over time, the polymer continues to collapse on the organic to create a permanent bond. The N960 has the ability to absorb aqueous waste up to 100 times its own weight. It creates a strong mechanical bond which permanently traps the contamination imbedded in the aqueous liquids. As a consequence, these two polymers seem to be able to constitute a suitable solidification matrix for a final acceptance in storage sites.

Generally liquid waste:polymer weight ratios will vary. Suitable weight ratios are from about 1:1 to 5:1, for example 1:1, 2:1, 4:1 and 5:1. Subranges are also suitable, for example 1.5:1, 2.5:1, 3.5:1 and 4.5:1. When styrene block co-polymers (e.g. N910) are utilized, waste:polymer ratios range between approximately 1:1 and 3:1. When cross linked co-polymers of acrylamides (e.g., N960) are utilized, waste:polymer ratios range between approximately 1:1 and 5:1. The inventors found that for non-aqueous LRW immobilization protocols a final waste form comprising 80 weight percent of waste meets compression requirements, with 50-60 weight percent ideal. Further, the inventors found that for aqueous LRW immobilization protocols, final waste forms comprising 10 percent aqueous material is suitable. Generally final waste forms comprising 10 percent aqueous and 90 percent organic (i.e. non-aqueous) provide good final resting form configurations.

A salient feature of the invention is its ability to process, encapsulate and sequester cesium containing waste. Cesium is considered most problematic due to its multi-valent nature; as such its solubility is wide ranging. So, if cesium can be effectively encapsulated by the invented method so as to satisfy Part 61 requirements, then other rad waste can also be sequestered. Suitable other radionuclides as candidates for encapsulation and sequestration include, but are not limited to Sr-90, Am-241, Pu-239, U-235, U-238, and others.

Figure 2:
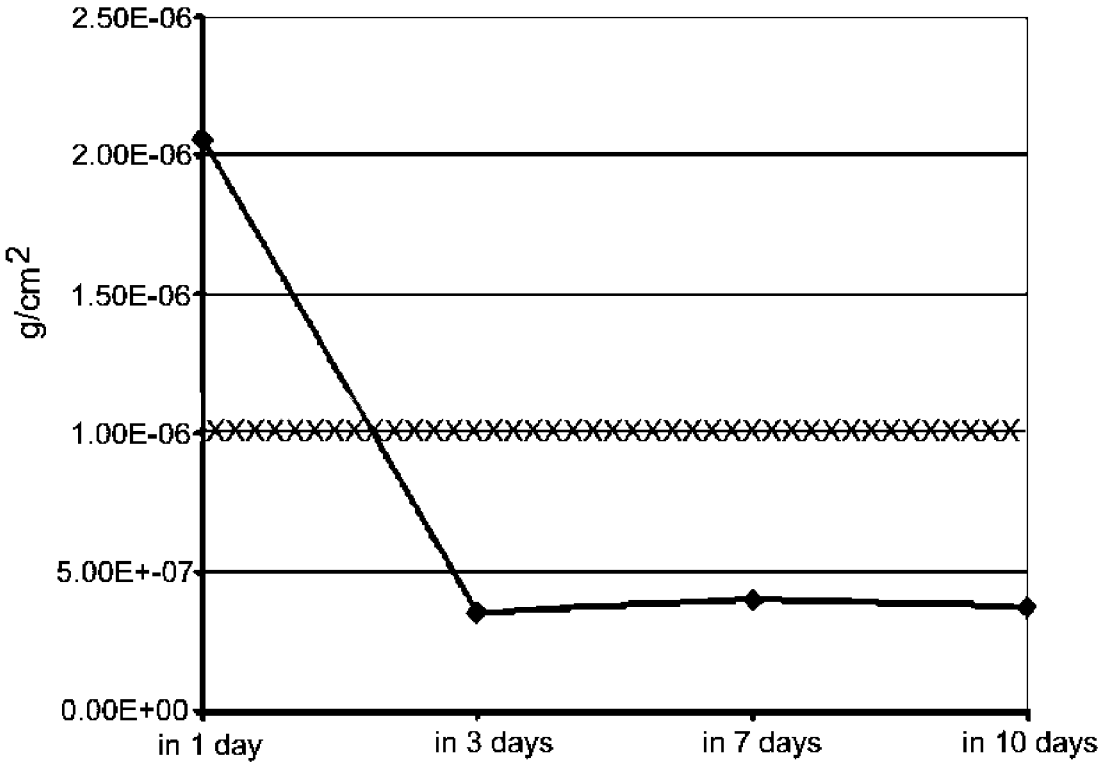
FIG. 2 is a graph showing rate of cesium leakage from a monolith created by the invented method, in accordance with features of the present invention.

FIG. 2 is a graph showing rate of cesium leakage from a sulfur containing monolith created by the invented method. The constituents of the monolith comprises 125 grams of N 910, 375 ml of liquid radioactive waste and 1100 grams of a mixture of sulfur (40 weight percent), barite (20 weight percent) and shale ash (40 weight percent). These constituents, once homogeneously mixed, were hot pressed in a mold at 140 C for up to 2 hours. A rubber like structure was produced with good anti-leaching (measured in g/cm$^2$) characteristics. This was indicative of sulfur co-polymerization.

The leakage rates depicted in FIG. 2 as grams per square centimeter (g/cm$^2$) are for illustration purposes only. The horizontal "X" line depicts threshold leach rates, below which such rates are acceptable.

As noted above, the inventors found that organic waste content in the final form can reach up to about 80 volume percent at a compressive strength of over approximately 100 kg per square centimeter. Harder forms are also possible. For example, if organic waste content is decreased to about 25 to 30 weight percent of the final waste form, compressive strength can increase up to about 300 kg/square centimeter. Oil-leaching rates of final forms range from between approximately $3\times10^{-6}$ to $2\times10^{-7}$ g/cm day. Generally good results are obtained with LRW is mixed with polymer in weight ratios ranging from between about 3:1 to 8:1.

In summary, the invention provides a method for transforming liquid radioactive waste into a solid and water-resistant matrix. Table 1 provides experiment results of some waste forms generated.

TABLE 1

Leach Rate for Invented Constructs Encapsulating Cesium.

| Oil (g) | Nochar 910 (g) | Sulfur (g) | Fillers (g) | Density (g/cm$^3$) | Strength (kg/cm$^2$) | Loading (%) | Cs Leaching rate, (g/cm$^2$day) |
|---|---|---|---|---|---|---|---|
| 43 | 7 | 33 | 67 | 1.4 | 150 | 40 | $5.0 \cdot 10^{-3}$ |
| 43 | 7 | 40 | 60 | 1.2 | 110 | 40 | $5.0 \cdot 10^{-3}$ |

TABLE 1-continued

Leach Rate for Invented Constructs Encapsulating Cesium.

| Oil (g) | Nochar 910 (g) | Sulfur (g) | Fillers (g) | Density (g/cm$^3$) | Strength (kg/cm$^2$) | Loading (%) | Cs Leaching rate, (g/cm$^2$day) |
|---|---|---|---|---|---|---|---|
| 26 | 10 | 5 | 10 | 1.4 | >150 | 60 | $2.4 \cdot 10^{-7}$ |
| 26 | 10 | 10 | 5 | 1.2 | >150 | 52 | $2.4 \cdot 10^{-7}$ |

Example 1

Experiments were performed on immobilization of styrene block co-polymer into sulfur composite saturated by a model solution of LRW (oil). A mixture was prepared and tested with the following composition: sulfur—40%, barite—20%, shale ash—40% with reinforcing chrysotile-asbestos additive, plasticizer and modifier. Different amounts of styrene block co-polymer saturated by model solution of LRW (oil) were introduced to this mixture.

The following composition was prepared: 30 ml of oil (with density of 0.88 g/cm$^3$) were mixed with about 10 g of styrene block co-polymer and about 15 g of hardening mixture from elemental sulfur and ash in the ratio of about 1:2. Then, the oil-containing gelatinous mass and hardening mixture were mixed, and heated at a temperature of about 140° C. to form a homogeneous mixture, which was molded under pressure in the shape of cylindrical samples. The samples hardened after 3 minutes. Visually oil separation from the sample was not observed, the obtained samples had the following characteristics: degree of oil inclusion in the composite—52 wt. % (65 vol. %), density—1.4 g/cm$^3$, during compressive test the samples amortized without destruction keeping the integrity, degree of leaching of oil was about 2 to $4\times10^{-7}$ g/(cm$^2$·day).

Example 2

Some variation was introduced in previous composition: 30 ml of oil (with density of 0.88 g/cm$^3$) were mixed with about 10 g of styrene block co-polymer about 7-8 g of hardening mixture (elemental sulfur and ash in the ratio of about 1:2) and about 7-8 g of pure sulfur. Then, the mixture prepared was mixed with oil-containing gelatinous mass and hardening mixture, and heated at a temperature of about 140° C. to form a homogeneous mixture which was molded under pressure in the shape of cylindrical samples. The samples hardened after about 3 minutes. Visually, oil separation from the sample was not observed, and the obtained samples had the following characteristics: degree of oil inclusion in the composite—52 wt. % (65 vol. %), density—1.2 g/cm$^3$, during compressive test the samples amortized without destruction, degree of leaching of radionuclides-2, $4\cdot10^{-7}$ g/(cm$^2$·day).

The steps of preparation are as follows: The oil is added to polymer intermixed during several minutes. Then sulfur composite mixture is added and thoroughly intermixed with polymer-oil mixture until its complete wetting followed by placing into the mold, heating at about 140° C., pressurizing and cooling. Styrene block co-polymers to oil ratio was taken at about 1:8. The samples amortized without destruction and have the leaching degree of $10^{-7}$ g/(cm$^2$·day) order. The samples were subjected to water and frost resistance tests. The sample is of leather like consistency and can be stretched as leather without destruction.

Example 3

The mixture was prepared of the following composition: 10 g Nochar-910+80 ml oil. After intermixing the mixture obtained was placed into drying oven at 140° C. for 40 minutes. After heat treatment the mixture was placed into hot mold and compacted while cooling. The sample produced of a jelly like mass is presented in FIG. 32. The sample didn't show any release of oil during compacting and no change of weight being kept in water for one month period confirming the results obtained on leaching rate of Nochar-910 saturated with real LRW (oil) in 8.3.

Thus, the proposed method allows reliable localizing radioactive oil waste into the matrix, to provide a degree of incorporation of waste oil into the sulfur composite up to 78.5 vol %, extending the range of binders suitable for fixing waste oils in them, and improving the cost effectiveness of management of radioactive oil due to reduction of the volume of hardened waste, and using of sulfur as a hardening agent.

Polymer-LRW mixtures can be immobilized into diatomite-cement, geocement and sulfur composite matrices complying with regulatory requirements on acceptance for storage and/or disposal.

Advanced materials of sulfur composite are obtained, which may be used for polymer-LRW encapsulation or immobilization into solid matrix after heat treatment.

Experiments on immobilization of styrene block co-polymers and oil into sulfur composite matrix showed that co-polymerization of styrene block co-polymers and sulfur takes place providing sulfur transfer into polymeric state without reaching the destructive crystalline state.

The samples of sulfur compound obtained in experiments carried out on immobilization of styrene block co-polymers (e.g. N910) saturated with real LRW (oil) in sulfur compound matrix show high water and leaching resistance meeting the requirements for long term storage and/or disposal.

It is to be understood that the above description is intended to be illustrative, and not restrictive. For example, the above-described embodiments (and/or aspects thereof) may be used in combination with each other. In one such instance, the inventors envision the storage of LRW-polymer constructs in premade sulfur containers. Whereas the specification of an embodiment of the invention up to this point teaches homogeneously mixing the LRW-polymer matrix with sulfur and fillers, in this envisioned embodiment, the gels are integrally molded or incorporated within interior layers of the containers, so as not to be homogeneously mixed with the sulfur or fillers.

In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A method for immobilizing non-aqueous liquid radioactive waste, the method comprising:

a) mixing the liquid waste with polymer to convert the liquid waste to a non liquid waste;

b) contacting the non-liquid waste with sulfur to create a mixture;

c) heating the mixture for a time and at a temperature to form homogeneous, chemically stable solid phase; and compressing the chemically stable solid phase into a final waste monolith wherein the mixture is in step c subjected to temperatures below the flash point of the liquid radioactive waste.

2. A method for immobilizing non-aqueous liquid radioactive waste, the method comprising:

a) mixing the liquid waste with polymer to convert the liquid waste to a non-liquid waste:

b) contacting the non-liquid waste with sulfur to create a mixture:

c) heating the mixture for a time and at a temperature to form homogeneous, chemically stable solid phase: and compressing the chemically stable solid phase into a final waste monolith wherein the mixture in step c is heated from between approximately 100° C. to approximately 250° C.

3. The method as recited in claim 2 wherein the polymer comprises an elastomer.

4. The method as recited in claim 2 wherein the polymer creates a permanent bond with the waste.

5. The method as recited in claim 2 wherein the solid phase is hardened by the compression.

6. The method as recited in claim 5 wherein the monolith remains leach free for up to about a year while immersed in water.

7. The method as recited in claim 2 wherein the final waste is up to about 10 weight percent aqueous.

8. The method as recited in claim 2 wherein the polymer is an elastomeric selected from the group consisting of styrene block co-polymers, cross linked co-polymers of acrylamide, and combinations thereof.

9. The method as recited in claim 2 wherein the waste comprises up to 100 volume percent of oil.

10. The method as recited in claim 2 wherein the waste comprises radioactive elements selected from the group consisting of cesium, uranium, plutonium, americium, and combinations thereof.

11. The method as recited in claim 2 wherein the weight ratio of polymer to waste ranges from between approximately 1:10 to approximately 10:1.

12. The method as recited in claim 2 wherein the non-aqueous radioactive waste is radiation-contaminated pump oil.

13. A method for immobilizing non-aqueous liquid radioactive waste, the method comprising:

a) mixing the liquid waste with polymer to convert the liquid waste to a non-liquid waste;

b) contacting the non-liquid waste with sulfur to create a mixture;

c) heating the mixture for a time and at a temperature to form homogeneous, chemically stable solid phase; and compressing the chemically stable solid phase into a final waste monolith wherein the polymers immobilize the nonaqueous liquid.

14. A method for immobilizing liquid radioactive waste containing tritium, the method comprising:

a) mixing the liquid waste with polymer to convert the liquid waste to a non-liquid waste;

b) contacting the non-liquid waste with a solidifying agent to create a mixture;

c) heating the mixture for a time and at a temperature to form homogeneous, chemically stable solid phase; and d) compressing the chemically stable solid phase into a final waste form, wherein the polymer comprises a mixture of styrene block co-polymers and cross linked co-polymers of acrylamides.

15. The method as recited in claim 14 wherein the ratio of styrene block co-polymers and cross linked co-polymers of acrylamides is approximately 9 to 1.

16. The method as recited in claim 14 wherein the heating step occurs in an atmosphere adapted to capture any vaporized tritium.

17. The method as recited in claim 14 wherein radioactive waste is radiation-contaminated pump oil.

18. The method as recited in claim 14 wherein the solidifying agent is an inorganic material comprising kaolin, diatomite, cement, ash, slag, sulfur, selenium and combinations thereof.

19. The method as recited in claim 14 wherein the weight ratio of polymer to waste ranges from between approximately 1:10 to approximately 10:1.

20. The method as recited in claim 14 wherein the mixture is heated from between approximately 100° C. to approximately 250° C.

* * * * *